US006511249B2

(12) United States Patent
Pelofi et al.

(10) Patent No.: US 6,511,249 B2
(45) Date of Patent: Jan. 28, 2003

(54) DEVICE FOR FIXING A LIFELINE AGAINST A WALL

(75) Inventors: Pierre-Georges Pelofi, Montpellier (FR); Pascal Lara, Vierzon (FR)

(73) Assignee: Dalloz Fall Protection, Vierzon (FR)

( * ) Notice: Subject to any disclaimer, the term of this patent is extended or adjusted under 35 U.S.C. 154(b) by 63 days.

(21) Appl. No.: 09/775,566

(22) Filed: Feb. 5, 2001

(65) Prior Publication Data

US 2001/0011721 A1 Aug. 9, 2001

(30) Foreign Application Priority Data

Feb. 3, 2000 (FR) ..... 00 01375

(51) Int. Cl.[7] ..... B63C 9/26
(52) U.S. Cl. ..... 403/222; 441/84
(58) Field of Search ..... 403/222, 223, 403/119, 319, 318; 248/58, 61, 65, 74.1, 74.2, 74.3; 441/84, 85

(56) References Cited

U.S. PATENT DOCUMENTS 4,547,164 A * 10/1985 Coles et al. ..... 441/84
5,224,427 A * 7/1993 Riches et al. ..... 104/115
5,807,007 A * 9/1998 Stemper ..... 403/13
5,950,970 A * 9/1999 Methany et al. ..... 248/150
5,957,416 A * 9/1999 Sellati ..... 248/61
6,018,847 A * 2/2000 Lu ..... 16/337
6,056,085 A * 5/2000 Cutter et al. ..... 182/36
6,330,861 B1 * 12/2001 Flux ..... 104/115

FOREIGN PATENT DOCUMENTS

GB 2336617 10/1999

* cited by examiner

*Primary Examiner*—Lynne H. Browne
*Assistant Examiner*—Kenn Thompson
(74) *Attorney, Agent, or Firm*—Greenblum & Bernstein, P.L.C.

(57) ABSTRACT

Device for attaching a rod to a wall comprising a clip having a channel section and two parallel lugs. A first sleeve and a second sleeve each have a longitudinal slot. Each of the first and second sleeves have a cylindrical part which is adapted to be disposed between the rod and the channel section of the clip. The clip is adapted to be attached to the wall via the two parallel lugs.

17 Claims, 3 Drawing Sheets

DEVICE FOR FIXING A LIFELINE AGAINST A WALL

CROSS-REFERENCE TO RELATED APPLICATIONS

The present application claims priority under 35 U.S.C. § 119 of French Patent Application No. 00 01375,filed on Feb. 3, 2000.

BACKGROUND OF THE INVENTION

1. Field of the Invention

The present invention relates to a device for fixing a lifeline against a wall.

The invention relates more particularly to lifelines utilizing a cable or a rod fixed horizontally to the facade of a building, an acroterion, or roof timbers. The lifelines substantially enable the attachment of a mobile element to which is attached one end of a cable. The other end of the cable is connected to a harness or to a belt in order to protect a worker working along the construction from falling accidentally.

2. Discussion of Background Information

Fixing members which are embedded in the facade of the building are generally attached to the lifelines.

Consequently, a sufficient number of such members must be provided at installation time and the members cannot be changed without partly or totally demounting the assembly.

One object of the invention is to provide a device that remedies this disadvantage.

SUMMARY OF THE INVENTION

The device in accordance with the invention includes a shackle with a core and two flanges and whose core is adapted to be fixed to a member embedded in the wall, a clip cut and bent to feature a channel section one edge of which is extended by a lug bent so that it is perpendicular to the axis of the channel section and the other edge of which, in the vicinity of the other end, is extended by a lug parallel to the first lug, and two sleeves made from a material with some elasticity and featuring a longitudinal slot enabling them to be mounted on a lifeline, each sleeve being conformed to feature a cylindrical part adapted to be inserted between the channel section and the lifeline and extended by a part which becomes thinner towards its free end, the flanges of the shackle and the lugs each including a hole, the holes being aligned so that a nut-and-bolt fastener can be passed through them.

A fixing device of the lifeline can therefore be replaced, added or demounted without having to demount the lifeline.

In accordance with one detail of construction, the flanges of the shackle are disposed between the lugs.

Finally, in accordance with another aspect of the invention, one of the holes in one of the lugs and the corresponding hole in the flange of the shackle are square and the bolt has a square-section shoulder near its head which can be inserted into the holes. The bolt is therefore held when the nut is tightened, which facilitates attaching the clip to the shackle.

The invention provides for a device for attaching a rod to a wall comprising a clip having a channel section and two parallel lugs, a first sleeve and a second sleeve each having a longitudinal slot. Each of the first and second sleeves have a cylindrical part which is adapted to be disposed between the rod and the channel section of the clip, wherein the clip is adapted to be attached to the wall via the two parallel lugs.

The device may further comprise a shackle adapted to be attached to the wall and the clip. The shackle may have a core which is adapted to be attached to the wall and two flanges which are adapted to be attached to the two parallel lugs of the clip. The shackle may be attached to the wall via a member embedded in the wall and wherein the two flanges which are attached to the two parallel lugs of the clip via a bolt. The two flanges and the two parallel lugs may each have a hole adapted to receive the bolt. The two flanges may be disposed between the two parallel lugs. At least one of the holes of the two flanges and the two parallel lugs may be a square hole. The two parallel lugs of the clip may be arranged perpendicularly to an axis running through the channel section of the clip. The two parallel lugs may each include a hole adapted to receive a bolt. The first and second sleeves may be made from a material with some elasticity. The longitudinal slot of the first and second sleeves may be adapted to receive the rod. The first and second sleeves may have a frustoconical section and a tongue. Each of the rod, the channel section, and the cylindrical part may comprise a circular cross-section. The rod may comprise one of a cable and a lifeline. The wall may comprise the wall of a building.

The invention also provides for a device for attaching a rod to a wall comprising a shackle adapted to be attached to the wall and having two flanges, a clip adapted to receive the rod and having two lugs, a first sleeve and a second sleeve each being adapted to receive the rod, each of the first and second sleeves being adapted to be disposed between the rod and the clip, wherein the two flanges of the shackle are adapted to be attached to the two lugs of the clip.

The invention further provides for a device for attaching a rod to a wall comprising a clip having a channel section adapted to receive the rod, a first sleeve and a second sleeve each having a longitudinal slot which is adapted to elastically receive the rod, each of the first and second sleeves being adapted to be partially disposed between the rod and the channel section of the clip, wherein the clip is adapted to be attached to the wall.

The invention will now be described in more detail with reference to one particular embodiment shown by way of example only in the accompanying drawings.

DETAILED DESCRIPTION OF THE PREFERRED EMBODIMENT

Figure 1:
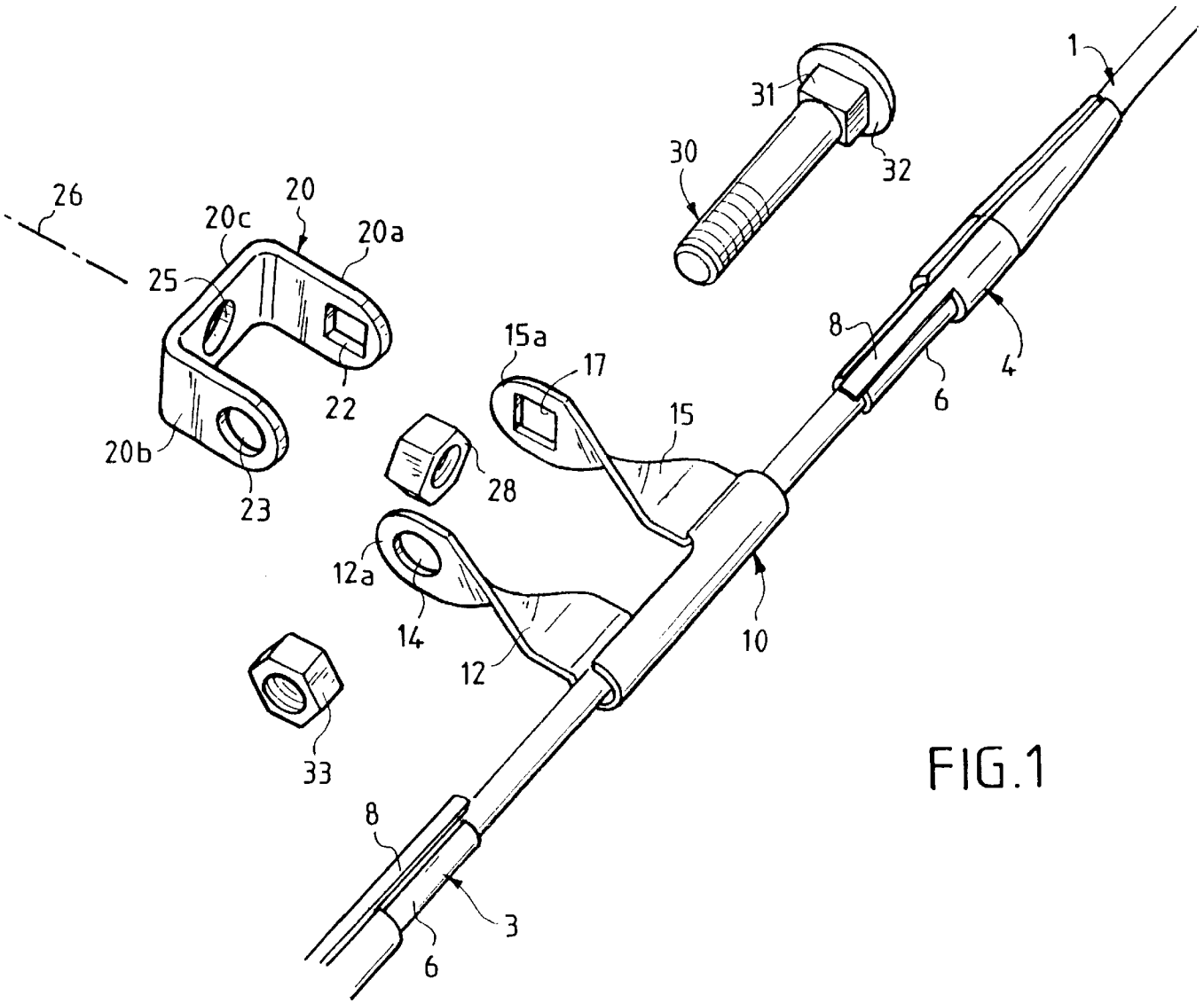
FIG. 1 is an exploded perspective view of a device according to the invention.

FIG. 1 shows a lifeline 1 having a rod or a cable made of metal and attached horizontally against a wall.

Two plastics material sleeves 3 and 4 are engaged over the rod 1 and each sleeve has a frustoconical part 5 extending from one end 5*a* which constitutes the smaller base to a shoulder 5*b* which constitutes the larger base and is extended by a cylindrical part 6.

The plastics material of the sleeves is an elastic material and a slot 7 is provided, extending from the end 5*a* to the free end of the cylindrical part 6. The sleeves can therefore be mounted anywhere on the rod 1 by opening the slot 7 elastically.

A tongue 8 is provided on a portion of the cylindrical part 6.

Figure 2:
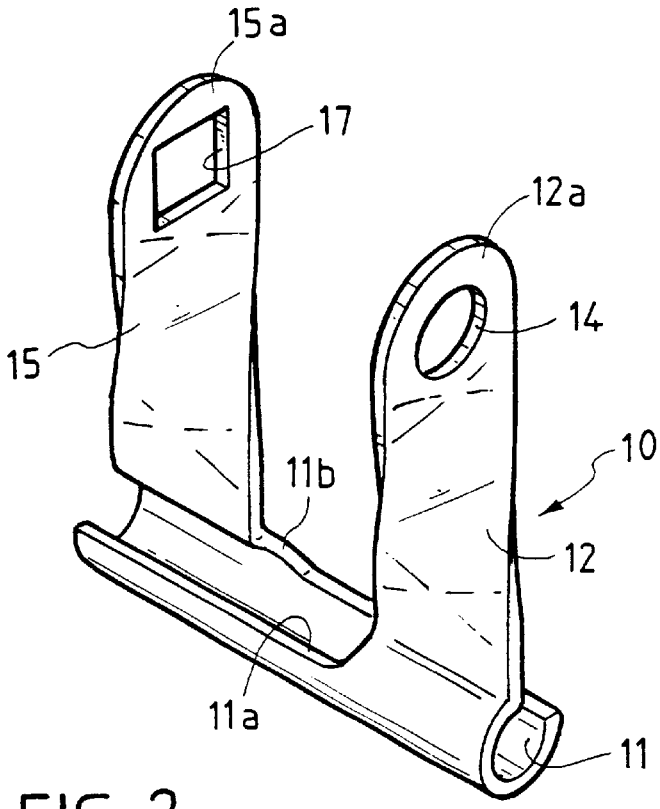
FIG. 2 is a perspective view of the clip to a larger scale.
Figure 3:
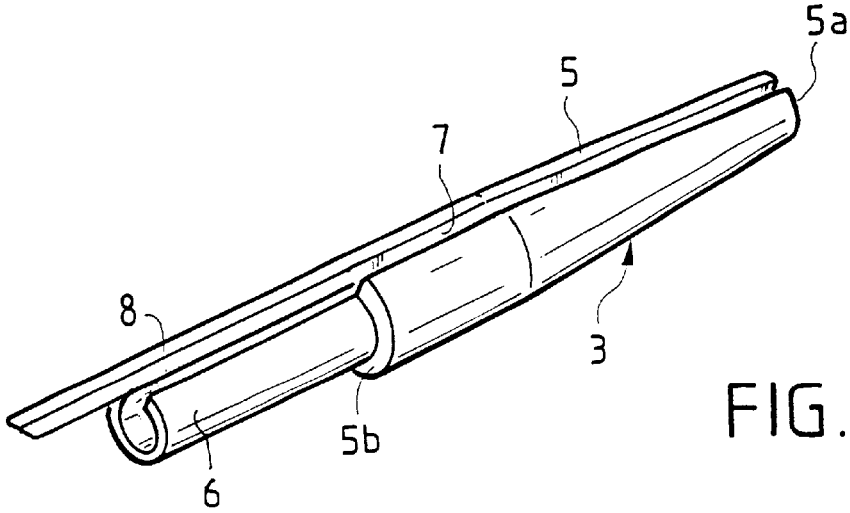
FIG. 3 is a perspective view of a sleeve to a larger scale.

The attaching device includes a clip 10 (see FIG. 2) made from a metal with some elasticity which is cut and shaped to feature a channel section 11 whose inside diameter is slightly smaller than the outside diameter of the cylindrical part 6.

The channel section 11 has a cross section in the shape of a circular arc subtending an angle of approximately 270° and is extended along one edge 11*a* at one end by a lug 12 which is bent so that its free end 12*a* is in a plane perpendicular to the axis of the channel section 11, with the lug incorporating a circular hole 14.

Along its other edge 11*b*, and in the vicinity of its end opposite that provided with the lug 12, the channel section 11 is extended by a second lug 15 which is bent so that its free end 15*a* is perpendicular to the axis of the channel section 11. The two lugs 12 and 15 are parallel.

The lug 15 has a square hole 17 in it near its free end and the holes 14 and 17 are aligned.

Finally, the device is completed by a shackle 20 which has two flanges 20*a* and 20*b* and a core 20*c*. The flange 20*a* includes a square hole 22 with the same dimensions as the hole 17 and the flange 20*b* includes a hole 23 aligned with hole 22 and has the same dimension as the hole 14.

The core 20*c* includes a hole 25 for a threaded rod embedded in the wall of the building and receiving a nut 28.

To mount the lifeline horizontally along a building, one or more shackles 20 are fixed to the wall of the building at regular intervals by one or more nuts 28 screwed onto the free ends of one or more threaded rods 26 buried in the thickness of the wall of the building and whose free ends pass through the holes 25.

Figure 4:
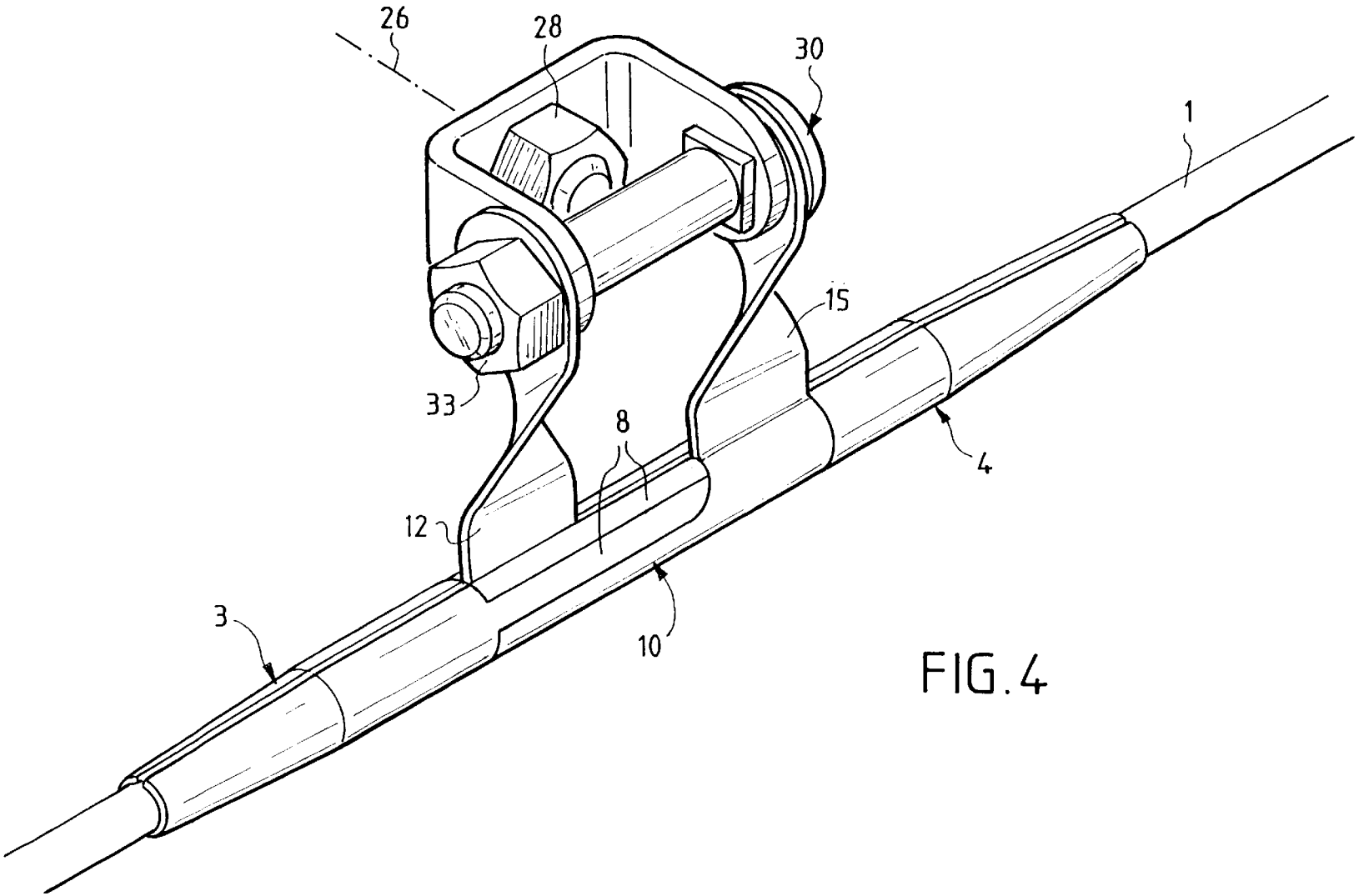
FIG. 4 is a perspective view of the assembled device.

The sleeves 3 and 4 are then fitted onto rod 1 so that the free ends of the cylindrical parts 6 are face-to-face with a gap between the ends, the clip 10 is then fitted over the rod 1, and the sleeves 3 and 4 are then pushed towards the clip to so that the cylindrical parts 6 are inserted in the channel section 11 and the free ends of the tongues 8 abut against the lugs 12 and 15 via edges 11*a* and 11*b* and lie in the open part of the channel section 11 (the shoulders 5*b* also abut against the ends of the clip 10 as is shown in FIG. 4). The clip 10 is then placed so that the lugs 12 and 15 are on respective opposite sides of the flanges 20*a* and 20*b*. The shackle 20 and the clip 10 are fastened together by a bolt 30 which has a head 32 with a square shoulder 31. The bolt 30 passes through the holes 17, 22, 23 and 14 and receives a nut 33. The shoulder 31 is inserted into the holes 17 and 22.

Of course, the invention is not limited to the embodiment that has just been described and shown. Many modifications of detail can be made thereto without departing from the scope of the invention.

What is claimed is:

1. A device for attaching a lifeline to a wall comprising:

a clip having a channel section and two parallel lugs;

a first sleeve and a second sleeve each having a longitudinal slot which receives the lifeline; and each of the first and second sleeves having a cylindrical part which is adapted to be disposed between the lifeline and the channel section of the clip, wherein the clip is adapted to be attached to the wall via the two parallel lugs.

2. The device of claim 1, further comprising a shackle adapted to be attached to the wall and the clip.

3. The device of claim 2, wherein the shackle has a core which is adapted to be attached to the wall and two flanges which are adapted to be attached to the two parallel lugs of the clip.

4. The device of claim 3, wherein the shackle is attached to the wall via a member embedded in the wall and wherein the two flanges are attached to the two parallel lugs of the clip via a bolt.

5. The device of claim 4, wherein the two flanges and the two parallel lugs each have a hole adapted to receive the bolt.

6. The device of claim 5, wherein the two flanges are disposed between the two parallel lugs.

7. The device of claim 5, wherein at least one of the holes of the two flanges and the two parallel lugs is a square hole.

8. The device of claim 1, wherein the two parallel lugs of the clip are arranged perpendicularly to an axis running through the channel section of the clip.

9. The device of claim 1, wherein the two parallel lugs each include a hole adapted to receive a bolt.

10. The device of claim 1, wherein the first and second sleeves are made from a material with some elasticity.

11. The device of claim 1, wherein the first and second sleeves have a frustoconical section and a tongue.

12. The device of claim 1, wherein each of the lifeline, the channel section, and the cylindrical part comprises a circular cross-section.

13. The device of claim 1, wherein the lifeline comprises one of a cable and a rod.

14. The device of claim 1, wherein the wall comprises the wall of a building.

15. A device for attaching a lifeline to a wall comprising:

a shackle adapted to be attached to the wall and having two flanges;

a clip adapted to receive the lifeline and having two lugs;

a first sleeve and a second sleeve each being adapted to receive the lifeline;

each of the first and second sleeves comprising a longitudinal slot which receives the lifeline;

each of the first and second sleeves being adapted to be disposed between the lifeline and the clip, wherein the two flanges of the shackle are adapted to be attached to the two lugs of the clip.

16. A device for attaching a lifeline to a wall comprising:

a clip having a channel section adapted to receive the lifeline;

a first sleeve and a second sleeve each having a longitudinal slot which is adapted to elastically receive the lifeline;

each of the first and second sleeves being adapted to be partially disposed between the lifeline and the channel section of the clip, wherein the clip is adapted to be attached to the wall.

17. A device for attaching a lifeline to a wall comprising:

a clip having a channel section adapted to receive the lifeline;

a first sleeve and a second sleeve each having an axial opening, a tongue and a longitudinal slot;

each axial opening being sized to receive the lifeline therein;

each longitudinal slot being elastically expandable to receive the lifeline;

each tongue engaging each other and the clip when the first and second sleeves are partially disposed in the channel section; and each of the first and second sleeves being adapted to slide into and out of the channel section such that when the first and second sleeves are slid into the channel section, each is at least partially disposed between the lifeline and the channel section of the clip, wherein the clip is adapted to be attached to the wall.

* * * * *